United States Patent [19]

Nishio et al.

[11] Patent Number: 4,612,163

[45] Date of Patent: Sep. 16, 1986

[54] METHOD OF MOLDING POWDERS OF METAL, CERAMIC AND THE LIKE

[75] Inventors: Hiroaki Nishio; Yasushi Ueno; Jun Harada, all of Yokohama, Japan

[73] Assignee: Nippon Kokan Kabushiki Kaisha, Tokyo, Japan

[21] Appl. No.: 768,578

[22] Filed: Aug. 23, 1985

[30] Foreign Application Priority Data

Sep. 4, 1984 [JP] Japan ..... 59-183780

[51] Int. Cl.[4] ..... B22F 1/00

[52] U.S. Cl. ..... 419/68; 249/65; 249/112; 249/183; 264/571; 264/DIG. 78; 425/405 H; 425/DIG. 14

[58] Field of Search ..... 419/68; 249/65, 112, 249/183; 264/571, DIG. 78; 425/405 H, DIG. 14

[56] References Cited

U.S. PATENT DOCUMENTS

| | | | |
|---|---|---|---|
| Re. 31,355 | 8/1983 | Rozmus | 419/48 |
| 3,523,148 | 8/1970 | Boyer et al. | 415/68 |
| 3,577,635 | 5/1971 | Bergman et al. | 419/68 |
| 3,956,452 | 5/1976 | Saito | 419/42 |
| 4,271,114 | 6/1981 | Ohno | 419/48 |

*Primary Examiner*—Stephen J. Lechert, Jr.

*Attorney, Agent, or Firm*—Fleit, Jacobson, Cohn & Price

[57] ABSTRACT

A method of compression molding powders of metals, ceramics and the like. A thin rubber bag is adhered to the inside of a cavity formed within a permeable mold support so as to define a mold therein and the bag is packed with a raw material powder. The powder in the bag is evacuated to a degree of vacuum to compactly compress it and the rubber bag is sealed. In this condition, the compressed powder is removed from the support and compression molded to a higher degree of denseness by the CIP process. The inflation adhesion of the rubber bag to the inside of the support cavity is effected by reducing the pressure outside the permeable support.

4 Claims, 6 Drawing Figures

METHOD OF MOLDING POWDERS OF METAL, CERAMIC AND THE LIKE

BACKGROUND OF THE INVENTION

1. Field of the Invention

The present invention relates to a method of molding powders of metal, ceramic and the like into compression moldings of complicated shapes.

2. Description of the Prior Art

Various methods of producing machine parts of high density and intricate shapes from powders of metals and ceramics by the combination of injection molding and sintering techniques are well known.

For example, the Wiech process comprises kneading metal powder of about 10 to 15 μm and a thermoplastic resin and preparing pellets, injection molding the pellets by the use of an oversized mold in consideration of the desired shrinkage allowance, degreasing the resulting molding by the application of heat or by solvent extraction to make it porous and then densifying the porous molding by a sintering operation and this process is used for the production of intricately shaped machine parts from iron nickel alloy, stainless steel, etc.

Also known in the art are techniques for the injection molding of sintered hard alloy, stellite, tool steel, superalloy, titanium, etc., and techniques for the injection molding of alumina, zirconia, silicon nitride, silicon carbide, sialon (Si-Al-O-N), graphite short fiber, etc.

More specifically, techniques are known for the manufacture for example of turbocharger rotors for automobile engines, turbine rotors for gas turbine engines, etc., by the injection molding of silicon nitride and silicon carbide.

While the injection molding methods used widely with these techniques have the advantage of ensuring high dimensional accuracy for products, they also have some disadvantages as enumerated below.

(1) Since a binder of as much as 30 to 40 volume % is added to provide a powder material with plasticity, a considerably long time is required for the degreasing operation and this does not conform with the injection molding techniques which should essentially be suited for the purpose of mass production in short time thus failing to enjoy the intended economic effect.

(2) Since the injection molds are expensive, the injection molding methods are not suited for multikind and small quantity production purposes.

(3) It is difficult to mold thick-walled parts without internal defects.

(4) Sophisticated technological accumulation as to the additon of binders and the selection of injection molding conditions is necessary and the occurrence of voids within moldings or the occurrence of flow marks on moldings will be caused if these conditions are improper.

In addition to these methods, there is another method of this kind of techniques in which after a powder material has been packed in a mold, the powder material is molded under the application of a hydrostatic pressure of about 2000 to 4000 atm ($2026.5\times10^5$ to $4053\times10^5$ Pa) by the cold isostatic press (CIP) process employing water or oil and then the material is transferred to a sintering stage thereby obtaining the final product.

With this method employing the CIP process, the hydraulic pressure is uniformly applied to a material to be molded and thus under the ideal conditions the density of a molding becomes uniform making it possible to mold parts of complicate shapes. Its first feature is the use of an inexpensive rubber mold and its second feature is the nonuse of any binder or the use of a very small amount of binder in the case of a granular powder material thus eliminating the disadvantage of the above (1). Also, its third feature resides in that the method is applicable to the production of thick-walled parts and this fact makes it possible to enjoy the advantage of not being subjected to the limitations due to the degreasing. Its fourth feature is the fact that there is no need for such sophisticated technological accumulation as in the case of the injection molding machine and its fifth feature resides in that although the mass processing in such a short period of times the injection molding is not possible, the elimination of the degreasing operation ensures, when considered in the light of the CIP process on the whole, a high degree of freedom which allows its use in applications ranging from the scant kind and mass production to the multikind and small quantity production.

The CIP processes are roughly divided into two types one of which is a wet-bag type and the other is a dry-bag type and here the subject interest is the wet-bag type which is suited for the molding of parts of complicated shapes due to the reduced limitations to the shape of the rubber mold.

With the CIP process having a number of advantages as mentioned above, however, the most serious disadvantage is inferiority in the dimensional accuracy of moldings (the accuracy is said to be in the range of ±0.3 and 1.5% at the most) and therefore the CIP process cannot be used for the production of parts requiring a high degree of dimensional accuracy.

In this respect, Japanese Patent Publication No. 37383/1972 discloses a method comprising inserting a rubber bag into a mold of a given shape, packing a powder material in the rubber bag, reducing the pressure within the bag and removing the rubber bag packed with the powder material from the mold while maintaining the shape of the mold and then subjecting the bag as such to the molding operation by an isostatic press and in this method the procedure of inserting into the mold a thin rubber bag conforming with its inside involves difficulty thus making it difficult for this method to produce moldings having a high degree of dimensional accuracy.

As mentioned hereinabove, the conventional methods have their own merits and demerits so that even any one of these methods is used, it is difficult to perform the CIP process if the merits and demerits of the method do not conform well with products to be molded.

SUMMARY OF THE INVENTION

It is an object of the present invention to provide a method of molding powders of metals, ceramics and the like, which improves the dimensional accuracy of the previously mentioned CIP process and which is capable of molding powder materials into parts having dimensional accuracy comparable to that of parts produced by the injection molding method and complicated in shape.

In accordance with one aspect of the invention, there is provided a method of molding powders of metals, ceramics and the like, which is characterized by closely fitting the opening of a baglike piece made of a thin rubber-like elastic material on the open gate of a permeable mold support communicated with a cavity formed within the support to define a mold, reducing the pressure of the atmosphere outside the permeable mold support to evacuate the interior of the cavity and thereby cause the baglike piece to closely adhere in an inflated form to the inside of the cavity in the permeable mold support, packing a raw material powder in the mold formed on the inner side of the baglike piece closely adhered to the cavity, evacuating the interior of the mold through the opening of the baglike piece to produce a vacuum therein and then sealing the mold, breaking up the permeable mold support and removing a preformed molding in the form contained in the baglike piece and processing the preformed molding by a cold isostatic press thereby densifying the preformed molding.

While the permeable mold support corresponds to the mold itself in terms of the ordinary conception, in the case of this invention the support is permeable and therefore there are cases where it cannot form a mold. In accordance with the invention, the support holds a rubber-like elastic material which is closely adhered in an inflated form to the inside of its cavity and the two define a so-called mold.

Since only the weight of a raw powder material is applied to the permeable mold support and there is no danger of causing any wear throughout the whole period of the molding stage, its strength and wear resistant function are not required to attain high levels.

As a result, any material may be arbitrarily selected as occasion demands from among plastics such as polyamide resin, polycarbonate resin, ABS resin and AS resin, metals such as copper alloy, stainless steel and aluminum, ceramics such as ceramic, alumina and silica and composite materials of ceramics and metals for use as its material.

Also, as regards its permeability, the mold support may be of the type having a mold defining cavity formed therein by the ordinary method and including a vent hole communicating with the cavity or it may be composed of a porous material provided by the use of a porous material or by the use of a foaming agent.

The baglike piece made of a thin rubber-lie elastic material is a bag made of natural rubber or synthetic rubber such as styrene butadiene rubber, polyisoprene or isobutylene-isoprene rubber and its thickness is suitably selected between 50 and 1000 μm although it cannot be determined indiscriminately depending on the size of the mold with which it is used, etc.

The raw material used should preferably be one processed to have such particle size and shape which ensure good flow properties. More specifically, spherical powder produced by the argon gas atomizing process, the vacuum atomizing process, the rotary electrode process or the like is suitable in the case of stainless steel, tool steel, superall or the like and spherical powder obtained by the rotary electrode process is also suitable in the case of titanium or titanium alloy. Also, fine powder of metal such as carbonyl iron, carbonyl nickel or the like, dispersion reinforced alloy powder of hard metal, alumina, zirconia, silicon nitride, silicon carbide, sialon, etc., are usually irregular-shaped fine powders of several μm with inadequate flow properties and therefore it is desirable to use them in the form of spherical powder procesed into granules.

In accordance with the method of this invention, it is possible to improve the dimensional accuracy of molded parts without using expensive tool steel as in the case of injection molds and it is possible to produce a molded part of greater accuracy by simply preliminarily causing a bag of rubber-like elastic material to have shape similar to that of the cavity.

The above and other objects as well as advantageous features of the invention will become more clear from the following description taken in conjunction with the drawings.

DESCRIPTION OF THE PREFERRED EMBODIMENTS

Figure 1:
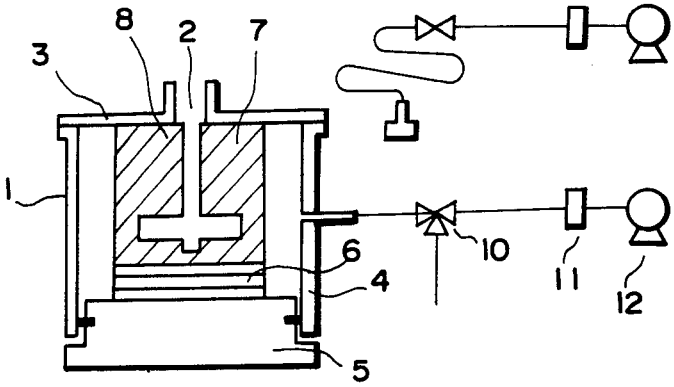
FIGS. 1 to 6 are schematic diagrams showing an example of a molding method according to the invention in the order of its processing steps.

Referring to FIGS. 1 to 6, a vacuum container 1 is composed of a top cover 3 including an open gate 2, a cylindrical member 4 and a lifting state 5. A permeable mold support 7 is mounted on the lifting stage 5 through a specimen support 6. The permeable mold support 7 is formed in its upper part with an opening 8 communicated with its internal cavity and the opening 8 is concentrically communicated with the gate 2. The upper surface of the support 7 is held in close contact with the lower surface of the top cover 3.

Figure 2:
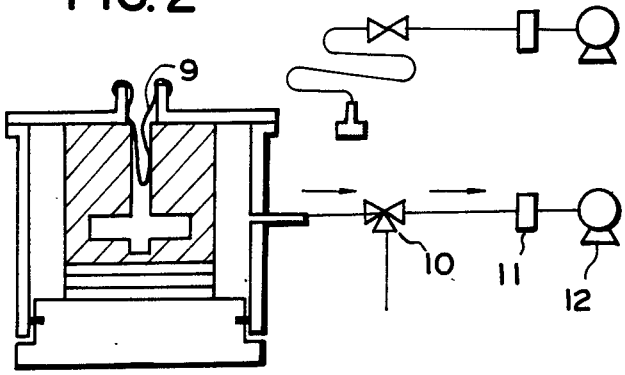

As shown in FIG. 2, firmly fitted on the gate 2 is the opening of a bag 9 comprising for example a thin bag of a rubber-like elastic material having a high degree of stretchability, e.g., a latex rubber bag of about 0.5 mm thick under no-load conditions and the bag 9 is inserted into the cavity of the permeable mold support 7.

When a vacuum pump 12 is operated through a dust filter 11 by utilizing a branch pipe fitted to a suitable portion of the cylindrical member 4, the outside of the permeable mold support 7 is reduced to a negative pressure so that the pressure difference between it and the atmospheric pressure causes the latex rubber bag 9 to inflate and closely adhere to all over the inner surface of the cavity of the permeable mold support 7 thereby forming a mold.

The use of an oversized rubber bag 9 must be avoided so as to prevent any wrinkles in the mold and also the use of an undersized bag 9 involves the danger of it being ruptured. Thus, due consideration must be given in selecting the size of a bag to be used.

Figure 3:
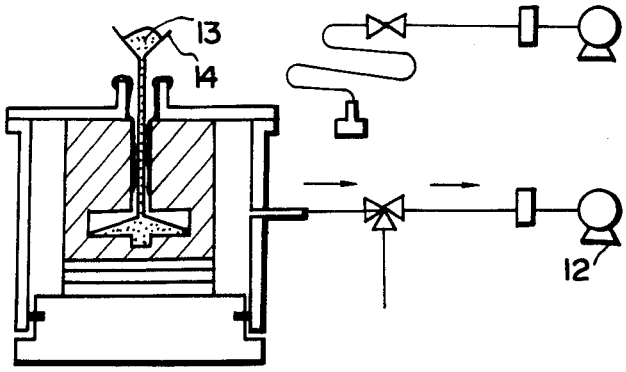

After the mold has been completed, as shown in FIG. 3, raw material powder 13 is fed into the mold by means of a feeder 14 and at this time the operation of the vacuum pump 12 is continued. During the feeding of the raw material powder 13, auxiliary means such as a vibrator is suitably selected and used for the purpose of packing the mold with the powder 13 uniformly with a greater packing density.

Figure 4:
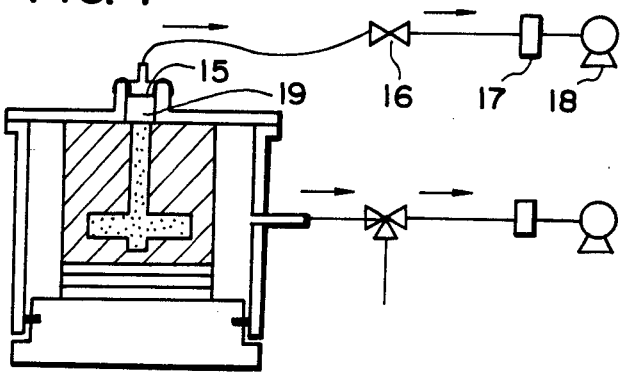
Figure 5:
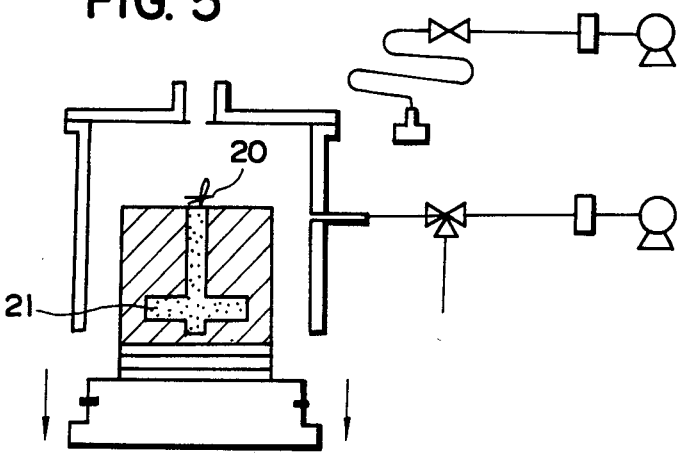

After the packing of the raw material powder 13 has been completed, as shown in FIG. 4, a dust filter 15 is arranged so as to define some space 19 between it and the raw material powder layer within the gate 2 and the space 19 is connected to a vacuum pump 18 through a valve 16 and a dust filter 17 thus exhausting the air existing in the voids of the haw material powder and reducing the internal pressure to 100 Torr ÷133 Pa) or less, preferably 10 Torr (÷13.3 Pa) or less. Of course, it is necessary that while this operation is being performed, the operation of the pump 12 is continued so that the pressure on the outside of the permeable mold support 7 (inside the vacuum container 1) is maintained lower than the pressure within the mold.

After the mold internal pressure has attained a predetermined value in this way, the vacuum pump 12 is stopped and a three-way cock 10 is switched thereby restoring the pressure within the vacuum container 1 to the atmospheric pressure. When this occurs, the rubber bag portion in the space 19 is crushed and the crushed portion is gripped by a clamp 20 thereby providing a seal.

Then, the vacuum container 1 is disassembled and the permeable mold support 7 is broken up thereby removing a preformed molding 21 covered with the rubber bag 9.

Since the internal pressure of the preformed molding 21 is negative, the hydrostatic pressure corresponding to the pressure difference between this negative pressure and the atmospheric pressure is always applied to the preformed molding 21 and thus its shape is maintained even after the removal of the permeable mold support 7.

Figure 6:
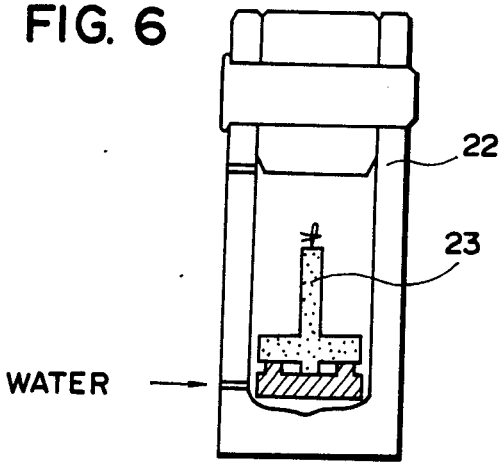

Finally, the preformed molding 21 covered with the rubber bag 9 is set as such in a CIP unit 22 as shown in FIG. 6 and water is supplied into the CIP unit 22 thus increasing the pressure up to 2000 to 4000 atm ($2026.5\times10^5\sim4053\times10^5$ Pa). This pressure is maintained for several minutes so that the preformed molding 21 is shrinked and densified thus producing a final product or molding 23. When removing the molding 23, even if the pressure reduction is performed rapidly, there is practically no air in the molding 23 and therefore there is no danger of such trouble as the occurrence of cracks due to expansion of the internal air.

The thus produced molding 23 can be easily removed by disengaging the clamp 20 and tearing off the latex rubber 9 corresponding to the outer covering. Then, if necessary, the molding 23 may be further degreased and sintered.

For example, a molding produced from a raw material consisting of granules of WC=10% Co hard metal may be subjected to degreasing, vacuum sintering and hot isostatic press (HIP) operations to produce a high-density sintered product and also a molding produced from a raw material consisting of granules of $Si_3H_4$-8% $Y_2O_3$ may be first degreased and then sintered in a nitrogen atmosphere at the normal pressure. Also, in the case of a molding obtained by using spherical granules produced by the rotary electrode process from a superalloy (IN 100) consisting essentially of nickel, the molding may be sintered in an argon atmosphere and then subjected to the HIP operation to obtain a desired product.

EXAMPLE

Using raw material powders respectively consisting of C1018 steel spherical powder (particle size of 80 to 200 mesh or 74 to 177 μm) and alumina granules (particle size of 20 to 100 μm), the powders were molded in molds each made by adhering a baglike rubber of 200 pm thick and 50 mm long to a gypsum mold support having a disk-shaped cavity of 80 mm diameter and 15 mm thick formed at a position of 80 mm from one end of a shaft having a diameter of 20 mm and a length of 100 mm. After densification by the CIP operation performed at a pressure of 3000 kg/cm$^2$ ($=2940\times10^5$ Pa), the roundnesses of the molded disks so prepared were measured with the result that there were little variations in the disk diameter and all of the variations were less than 0.2%.

In this example, the disk diameters were as follows.

| | |
|---|---|
| Steel spherical powder | 72.90 ± 0.13 mm |
| Alumina granules | 68.10 ± 0.09 mm |

What is claimed is:

1. A method of molding powders of metals, ceramics and the like comprising the steps of:

closely fitting an opening of a baglike member made of a thin rubber-like elastic material on an open gate of a permeable mold support communicated with a cavity formed within said support to define a mold therein;

reducing the pressure of an atmosphere outside said permeable mold support to evacuate said cavity to such a degree that said baglike member is inflated and adhered to the inside of said cavity in said permeable mold support thereby forming a mold;

packing said mold with a raw material powder;

evacuating said mold to a desired degree of vacuum through the opening of said baglike member and sealing said mold;

dismounting and breaking said permeable mold support to remove a preformed molding in a form contained in said baglike member; and processing said preformed molding by a cold isostatic press to densify the same.

2. A molding method according to claim 1, wherein said permeable mold support is made of a material selected from the group consisting of polyamide resin, copper alloy, stainless steel, aluminum, alumina and silica, and wherein said support is formed with a vent hole for exhausting a gaseous body within said cavity.

3. A molding method according to claim 1, wherein said permeable mold support is made of a material selected from the group consisting of permeable ceramic, porous sintered alloy and gypsum thereby making the same porous.

4. A molding method according to claim 1, wherein said baglike member is made of natural rubber or synthetic rubber and has a thickness of 50 to 100 μm.

* * * * *